US007546929B2

(12) United States Patent
Wierzba et al.

(10) Patent No.: US 7,546,929 B2
(45) Date of Patent: Jun. 16, 2009

(54) POWERED AUXILIARY HOIST MECHANISM FOR A GANTRY CRANE

(75) Inventors: Jerry J. Wierzba, Sturgeon Bay, WI (US); John E. Braun, Sturgeon Bay, WI (US)

(73) Assignee: Marine Travelift, Inc., Sturgeon Bay, WI (US)

( * ) Notice: Subject to any disclaimer, the term of this patent is extended or adjusted under 35 U.S.C. 154(b) by 85 days.

(21) Appl. No.: 11/284,802

(22) Filed: Nov. 22, 2005

(65) Prior Publication Data

US 2007/0095777 A1 May 3, 2007

Related U.S. Application Data

(60) Provisional application No. 60/731,954, filed on Oct. 31, 2005.

(51) Int. Cl.
*B66C 19/00* (2006.01)

(52) U.S. Cl. ..... 212/345; 212/326; 212/338

(58) Field of Classification Search ..... 212/324–326, 212/343–345, 316, 322, 330–334, 327
See application file for complete search history.

(56) References Cited

U.S. PATENT DOCUMENTS

| | | | | |
|---|---|---|---|---|
| 1,430,009 | A | | 9/1922 | Harry et al. |
| 3,075,603 | A | | 1/1963 | Baudhuin |
| 3,081,883 | A | | 3/1963 | Minty |
| 3,297,170 | A | | 1/1967 | McCready et al. |
| 3,389,809 | A | | 6/1968 | Wilson |
| 3,494,491 | A | | 2/1970 | Sumida |
| 3,513,987 | A | | 5/1970 | Seyff |
| 3,645,406 | A | | 2/1972 | Brazell |
| 3,696,881 | A | | 10/1972 | Gordon |
| 3,721,358 | A | * | 3/1973 | Brock ..... 414/460 |
| 3,792,779 | A | | 2/1974 | Brazell |
| 3,854,592 | A | | 12/1974 | Mordre |
| 3,874,516 | A | | 4/1975 | Watanabe |
| 3,933,215 | A | | 1/1976 | Scheuerle |
| 3,933,218 | A | | 1/1976 | Oler et al. |
| 3,999,672 | A | | 12/1976 | Brock |
| 4,144,974 | A | | 3/1979 | Longthorpe |
| 4,200,162 | A | | 4/1980 | Tax |
| 4,219,094 | A | | 8/1980 | Sturgill |
| 4,263,979 | A | | 4/1981 | Sturgill |

(Continued)

FOREIGN PATENT DOCUMENTS

DE DT 1756299 12/1970

*Primary Examiner*—Thomas J. Brahan
(74) *Attorney, Agent, or Firm*—Banner & Witcoff, Ltd.

(57) ABSTRACT

A gantry crane (10) is configured in a panel turner application. The gantry crane (10) generally includes a gantry crane structure (14) having a first cross-beam (28) and a second cross-beam (30). A first main hoist mechanism (40) and a first auxiliary hoist mechanism (42) are coupled to the first cross-beam (28), and a second main hoist mechanism (44) and a second auxiliary hoist mechanism (46) are coupled to the second cross-beam (30). The crane (10) includes a hydraulic system configured to reduce the lift capacity of the first and/or second main hoist mechanism (40, 44), and to equalize the hoist capacity between the first and second main hoist mechanisms (40, 44) or the first and second auxiliary hoist mechanisms (42, 46) in certain applications. The auxiliary hoist mechanism (42, 46) are configured for powered movement along the respective cross-beams (28, 30).

8 Claims, 7 Drawing Sheets

U.S. PATENT DOCUMENTS 4,284,159 A 8/1981 Voelz
4,360,112 A 11/1982 Brewer et al.
4,360,304 A 11/1982 Brewer et al.
4,378,072 A 3/1983 Appleman et al.
4,444,287 A 4/1984 Voelz
4,457,389 A 7/1984 Voelz
4,531,604 A 7/1985 Lamer
4,544,070 A 10/1985 Sickler
4,599,030 A 7/1986 Skaalen et al.
4,657,150 A 4/1987 Glickman et al.
4,664,270 A 5/1987 Voelz
4,667,834 A 5/1987 Lanigan et al.
4,697,487 A * 10/1987 Cameron ..... 83/708
4,749,328 A 6/1988 Lanigan, Jr. et al.
4,823,899 A 4/1989 Ron
4,880,124 A 11/1989 Feider et al.
4,927,034 A 5/1990 Holden
5,180,070 A 1/1993 Feider
5,699,873 A 12/1997 Moriya et al.
5,804,932 A * 9/1998 Yanagisawa ..... 318/6
5,810,183 A 9/1998 Feider et al.
5,845,494 A 12/1998 Nishizawa et al.
5,893,471 A 4/1999 Zakula
6,109,379 A 8/2000 Madwed
6,163,116 A 12/2000 Tanquary et al.
6,193,086 B1 2/2001 Gunnlaugsson et al.
6,206,127 B1 3/2001 Zakula et al.
6,486,787 B2 11/2002 Rieger et al.
6,827,176 B2 12/2004 Bean et al.
6,968,963 B1 11/2005 Zakula, et al.
2005/0287010 A1 12/2005 Below

* cited by examiner 46
42
SINGLE JOYSTICK
ACTUATED HOIST
CIRCUITS INDEPENDENT
87
88
86
79
72
82
80
78
84
68

46
42
BOTH HOIST JOYSTICKS
ACTUATED EITHER DIRECTION
HYDRAULICALLY EQUALIZES
HOISTS WHEN IN "AUX" OR
"ALL" SELECTION MODE
87
88
86
79
72
82
80
78
84
68

POWERED AUXILIARY HOIST MECHANISM FOR A GANTRY CRANE

CROSS-REFERENCE TO RELATED APPLICATIONS

The present application claims the benefit of Provisional Application No. 60/731,954, filed on Oct. 31, 2005, which is incorporated herein by reference. Additionally, the present application is related to U.S. patent application Ser. No. 11/058,738, entitled "Steering System for Crane" owned by Assignee of the present invention which is incorporated herein by reference. The present invention is also related to the concurrently filed U.S. patent application Ser. No. 11/285,374 entitled "Panel Turner For Gantry Crane" owned by Assignee of the present application which is also incorporated herein by reference.

FEDERALLY SPONSORED RESEARCH OR DEVELOPMENT

N/A

TECHNICAL FIELD

The present invention generally relates to load lifting mechanisms used on cranes and, more particularly, to certain hoist features for a gantry crane.

BACKGROUND OF THE INVENTION

Industrial cranes, such as gantry cranes, are used for lifting and transporting large cargo containers and other loads to and from railroad cars, truck trailers and other locations, as well as for lifting and transporting boats. The gantry crane typically has a gantry structure comprising a series of connected beams that span over a large item to be lifted.

Each beam of a gantry crane supports a main hoist and an auxiliary hoist. Both the main hoist and the auxiliary hoist are coupled to the beam by a trolley assembly for effecting lateral movement of the hoist along the beam. Precise positioning of the hoists is important in many lifting applications.

The gantry crane can be configured or utilized in a panel turner application wherein a lift assembly is operably attached to the gantry structure and is designed to lift and manipulate, for example, large prestressed concrete slabs or panels that may weigh many tons apiece. While panel turners for gantry cranes according to the prior art provide a number of advantageous features, they nevertheless have certain limitations.

The present invention is provided to overcome certain of these limitations and other drawbacks of the prior art, and to provide advantages and aspects not provided by prior cranes or panel turners. A full discussion of the features and advantages of the present invention is deferred to the following detailed description, which proceeds with reference to the accompanying drawings.

SUMMARY OF THE INVENTION

The present invention provides improved features for a lifting mechanism utilized in a crane. Specifically, according to a preferred aspect of the invention, the improved features are applicable for use with a panel turner for a gantry crane.

According to one aspect of the invention, a gantry crane has a gantry structure including a first horizontal beam and a second horizontal beam, and lift mechanisms secured to the horizontal beams. The lift mechanisms can include hoist mechanisms (sometimes referred to simply as "hoists") and trolley assemblies for lateral movement on the horizontal beams. Typically, the gantry crane will include a main hoist trolley and an auxiliary hoist trolley on each beam which are controlled by a hydraulic system. The hydraulic system of the present invention is configured to reduce the hoist capacity (i.e., the lifting capacity) of the main hoist trolleys to protect the overhead horizontal beams from being overloaded. This is done when it is necessary to use both the main hoist and the auxiliary hoist to lift a load.

In a typical application, each horizontal beam of the gantry crane is rated for 25 tons, wherein the two horizontal beams being rated for a total of 50 tons. That is, each beam can safely support 25 tons of weight without undo risk of failure. Similarly, each of the lifting mechanisms are also rated at a certain capacity. For example, each main hoist trolley is rated for 25 tons while each auxiliary hoist trolley is rated for 12 tons. Accordingly, as there is a main hoist trolley and an auxiliary hoist trolley on each horizontal beam, there is a 37 ton capacity by the hoist trolleys on each beam. With both sets of trolleys on each beam, there is a 74 ton total capacity.

Thus, the main hoist trolley and the auxiliary hoist trolley have a total capacity (i.e., 37 tons) that is greater than the capacity rating of the horizontal beam (i.e., 25 tons). In addition, all of the trolleys have a total lifting capacity (74 tons) that is greater than the total rating of both horizontal beams (50 tons).

In situations that require use of the main hoist trolley and the auxiliary hoist trolley, the hydraulic system of the gantry crane of the present invention is configured to reduce the main hoist capacity to a lesser amount. Preferably, the main hoist trolley is limited to 13 tons (or less) so that with the auxiliary hoist trolley rated at 12 tons, a total lifting capacity of each set of main and auxiliary hoist trolleys will be 25 tons (or less). This will then match (or be lower than) the 25 ton rating of the horizontal beam. In this manner, any attempt made to lift a greater weight will be prevented. Instead, the lifting mechanisms will de-rate, thereby avoiding significant damage to the beams or other portions of the crane's support structure.

The system uses a load sense diverter valve and load sense pressure limiting valve in the hydraulic circuit controlling the main hoist directional control valve to accomplish the hoist capacity reduction. Thus, if a hoist selection is made which utilizes both the main and auxiliary hoists for one of the beams, or all four of the hoists are selected by the operator, the hoist command signal from the operator causes the load sense pressure signal from the main hoist directional valve to be diverted through the pressure limiting valve to reduce the main hoist trolley lifting capacity (when all four hoist are selected for use this reduction in capacity is done on both main hoists). This protects the crane from overloading the overhead horizontal beams.

According to another aspect of the invention, the panel turner system provides for equalizing the hoisting capacity of the auxiliary hoists in certain applications. If more than one auxiliary hoist joystick is actuated, the system utilizes a common hydraulic line to hydraulically equalize the auxiliary hoists. This will assure that the auxiliary hoists carry equal portions of the lifted load (e.g., when lifting or lowering the load). This feature helps to prevent unequal load distribution between the auxiliary hoists which could otherwise result in damage to the lifted load and/or the gantry crane.

According to yet another aspect of the invention, a load lifting assembly is provided comprising a load lifting support structure having a first horizontal beam with a first main hoist mechanism and a first auxiliary hoist mechanism coupled to the first horizontal beam. A hydraulic circuit is configured to operate the first hoist mechanism coupled to the first horizontal beam. A first load sense pressure limiting valve is incorporated in the hydraulic circuit and is configured to reduce the lift capacity of the first hoist mechanism coupled to the first horizontal beam when both the first main hoist mechanism and the first auxiliary hoist mechanism are utilized to lift the load. Specifically, a diverter valve incorporated in the first hydraulic circuit is configured to divert a hydraulic control line from a main hoist directional control valve in the hydraulic circuit through the pressure limiting valve to the pressure compensated load sense pump when both the first main hoist mechanism and the first auxiliary hoist mechanism are utilized to lift a load. In this manner, the pressure limiting valve is able to control or adjust the pressure in a hydraulic pressure line from the pressure compensated load sense pump to the main hoist directional control valve.

Each of the first main hoist mechanism and first auxiliary hoist mechanism coupled to the first horizontal beam can comprise a trolley assembly to facilitate movement along the first horizontal beam. The first main hoist mechanism can be fixedly connected to a chain or cable which spans the beam from one end to the other end. The chain or cable can be configured in a loop wherein rotation of the chain or cable moves the first main hoist mechanism along the beam. A first motor can be used to drive the chain or cable on the beam.

The first auxiliary hoist mechanism can include a motor in the trolley assembly to allow for motorized (i.e., powered) movement of the auxiliary hoist mechanism along the chain or cable. Alternatively, a first hydraulic cylinder can be coupled to both the first main hoist mechanism and first auxiliary hoist mechanism to facilitate relative movement or separation between the first main hoist mechanism and the first auxiliary hoist mechanism.

The hoist mechanisms each include a load engagement member. The load engagement member can be, for example, in the form of a hook or other similar structure for connecting the hoist mechanism to the load.

The load lifting assembly can further comprise a second horizontal beam spaced apart from the first horizontal beam, such as in a gantry crane. The second horizontal beam can include a second main hoist mechanism and a second auxiliary hoist mechanism coupled to the second horizontal beam. The hydraulic circuit is configured to also operate the second main hoist mechanism coupled to the second horizontal beam. Specifically, the main hoist directional control valve includes a first output control line to control the hoist motor of the first main hoist mechanism, and a second output control line to control the hoist motor of the second main hoist mechanism.

According to another aspect of the invention, a method of lifting a load using a load lifting assembly having a load support structure with a set lift capacity, without exceeding the lift capacity of the load support structure is provided. The method comprises the steps of providing a first lift support beam having a first weight capacity, and providing a first main hoist mechanism coupled to the first lift support beam having a second weight capacity, and a first auxiliary hoist mechanism coupled to the first support beam having a third weight capacity wherein the second weight capacity and the third weight capacity are collectively greater than the first weight capacity. The method further includes selecting both the main hoist mechanism and the auxiliary hoist mechanism to lift the load and reducing the ability of the main hoist mechanism to a reduced second weight capacity wherein the reduced second weight capacity and the third weight capacity are collectively not greater than the first weight capacity. After reducing the capacity of the first main hoist mechanism, the method then provides for lifting the load with the first main hoist mechanism at the reduced second weight capacity and the first auxiliary hoist mechanism. The method further includes providing a hydraulic system to operate the first main hoist mechanism.

The step of reducing the second weight capacity can include providing a signal to a diverter valve indicating use of both the main hoist mechanism and the auxiliary hoist mechanism, and diverting pressure used to control the pressure compensated load sense pressure pump.

The method can further include the steps of providing a second lift support beam having a fourth weight capacity, providing a second main hoist mechanism coupled to the second lift support beam having a fifth weight capacity, and a second auxiliary hoist mechanism coupled to the second support beam having a sixth weight capacity wherein the fifth weight capacity and the sixth weight capacity are collectively greater than the fourth weight capacity. The method further includes reducing the fifth weight capacity to a reduced fifth weight capacity, wherein the reduced fifth weight capacity and the sixth weight capacity are not greater than the fourth weight capacity, and lifting the load with the second main hoist mechanism at the reduced fifth weight capacity and the second auxiliary hoist mechanism.

This method can be employed in a panel turner application and can include lifting a panel with the first main hoist mechanism, the first auxiliary hoist mechanism, the second main hoist mechanism and the second auxiliary hoist mechanism and, turning the panel with the first main hoist mechanism, the first auxiliary hoist mechanism, the second main hoist mechanism and the second auxiliary hoist mechanism. The panels are typically turned from a generally horizontal position to a generally upright position to more efficiently store the panels.

According to yet another aspect of the invention, a load lifting assembly comprises a load lifting support structure including a first horizontal beam and a second horizontal beam spaced apart from the first horizontal beam, a first main hoist mechanism coupled to the first horizontal beam, a second main hoist mechanism coupled to the second horizontal beam, a first hydraulic circuit configured to operate the first hoist mechanism, and a second hydraulic circuit configured to operate the second hoist mechanism. The assembly further includes a first equalization valve system configured to connect the first hydraulic circuit and the second hydraulic circuit to a common hydraulic line when energized. In some instances, two or more equalization valves can be utilized in the system. The equalization valve system is energized when both the first hoist mechanism and the second hoist mechanism are utilized together to lift a load. The first and second hoist mechanisms can be the main hoist mechanisms of the first and second cross-beams of a gantry crane, or the auxiliary hoist mechanisms utilizing a second equalization valve system to couple the auxiliary hoist mechanisms to a common line.

The load lifting assembly further comprises a control element having a first control position to allow for independent operation of the first hydraulic circuit and the second hydraulic circuit, and a second control position for energizing the equalization valve(s). The control element can include one or more joysticks, for example. The assembly can be used to lift and turn a panel.

According to yet another embodiment of the invention, a load lifting assembly with powered auxiliary hoist mechanisms comprises a load lifting support structure having a first horizontal beam having a first end and a second end, and a second horizontal beam having a first end and a second end.

The second horizontal beam is positioned generally parallel to and spaced apart from the first horizontal beam, such as in a gantry crane structure. A first cable loop is connected to the first horizontal beam and extends from proximate the first end of the first horizontal beam to proximate the second end of the first horizontal beam. A first powered drive mechanism for rotating the first cable loop is connected to the horizontal beam. The first powered drive mechanism includes a motor connected to a drive sprocket for effecting clockwise or counter clock-wise rotation of the drive sprocket.

The assembly includes a first main hoist mechanism including a main trolley assembly connected to the first horizontal beam. The main trolley assembly is fixedly coupled to the first cable loop such that rotation of the first cable loop about the drive sprocket causes the main trolley assembly of the first main hoist mechanism to move along the first horizontal beam.

The assembly also includes a first auxiliary hoist mechanism including an auxiliary trolley assembly connected to the first horizontal beam and coupled to the first cable loop. The auxiliary trolley assembly includes a motor wherein activation of the motor causes the auxiliary trolley assembly of the first auxiliary hoist mechanism to move along the first horizontal beam. The auxiliary hoist trolley includes a drive sprocket which engages the cable, and which is driven by the motor in the auxiliary trolley assembly, either clockwise or counter-clockwise to move the auxiliary hoist mechanism to a desired location on the horizontal beam.

The second horizontal beam includes a similar arrangement as the first horizontal beam for effecting movement of the second main hoist mechanism and second auxiliary hoist mechanism.

According to yet another embodiment of the invention, a gantry crane configured for lifting a load comprises a support structure including a first horizontal beam and a second horizontal beam spaced apart from the first horizontal beam. A lifting assembly in the crane includes a first main hoist mechanism mounted for lateral movement along the first horizontal beam, a second main hoist mechanism mounted for lateral movement along the second horizontal beam. Additionally, the lifting assembly includes a first powered auxiliary hoist mechanism mounted for lateral movement along the first horizontal beam; and, a second powered auxiliary hoist mechanism mounted for lateral movement along the second horizontal beam. The powered auxiliary hoist mechanisms can each include a motor for powered movement along the beam. Alternatively, the powered auxiliary mechanism can be coupled to a second cable (e.g., on the other side of the beam) and operate in the same manner as the main hoist mechanism. In this embodiment, a second motor and sprocket move the second cable to cause lateral movement of the auxiliary hoist mechanism.

According to yet another embodiment of the invention, a gantry crane comprises a first side support frame, a second side support frame, a first cross-beam having a first end connected to the first side support frame and a second end connected to the second side support frame, and a second cross-beam having a first end connected to the first side support frame and a second end connected to the second side support frame, the second cross-beam being spaced from the first cross-beam. A first hoist assembly is positioned on the first cross-beam, the first hoist assembly having a first main hoist mechanism and a first auxiliary hoist mechanism and a first drive assembly operably coupled to the first main hoist mechanism and the first auxiliary hoist mechanism wherein the first main hoist mechanism and the first auxiliary hoist mechanism are driven along the first cross-beam. Additionally, the crane includes a second hoist assembly on the second cross-beam, the second hoist assembly having a second main hoist mechanism and a second auxiliary hoist mechanism and a second drive assembly operably coupled to the second main hoist mechanism and the second auxiliary hoist mechanism wherein the second main hoist mechanism and the second auxiliary hoist mechanism are driven along the second cross-beam.

The first drive assembly is capable of moving the first main hoist mechanism and the first auxiliary hoist mechanism along the first cross-beam independently of one another. Similarly, the second drive assembly is capable of moving the second main hoist mechanism and the second auxiliary hoist mechanism along the second cross-beam independently of one another.

The first drive assembly can include a first chain drive operably coupled to the first cross-beam wherein the first main hoist mechanism and the first auxiliary hoist mechanism are operably connected to the first chain drive. The first main hoist mechanism can be fixedly secured to the first chain drive, and the first auxiliary hoist mechanism can include a motor mounted in the first auxiliary hoist mechanism for moving the first auxiliary hoist mechanism along the first chain drive. Again, a similar arrangement can be utilized for the second main hoist mechanism and second auxiliary hoist mechanism. Alternatively, the drive assemblies can include a first cable on each beam for moving the main hoist mechanism, and a second cable for moving the auxiliary hoist mechanism.

The gantry crane can include additional structure. For example, the first side support frame can include a front leg and the second side support frame can include a front leg, wherein the first end of the first cross-beam is connected to the front leg of the first side support frame and the second end of the first cross-beam is connected to the front leg of the second side support frame. Similarly, the first side support frame can include a rear leg and the second side support frame can include a rear leg, wherein the first end of the second cross-beam is connected to the rear leg of the first side support frame and the second end of the first cross-beam is connected to the rear leg of the second side support frame. Additionally, the front leg and the rear leg of the first side support frame and the second side support frame can each be connected by a respective lower side beam and an upper side beam.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
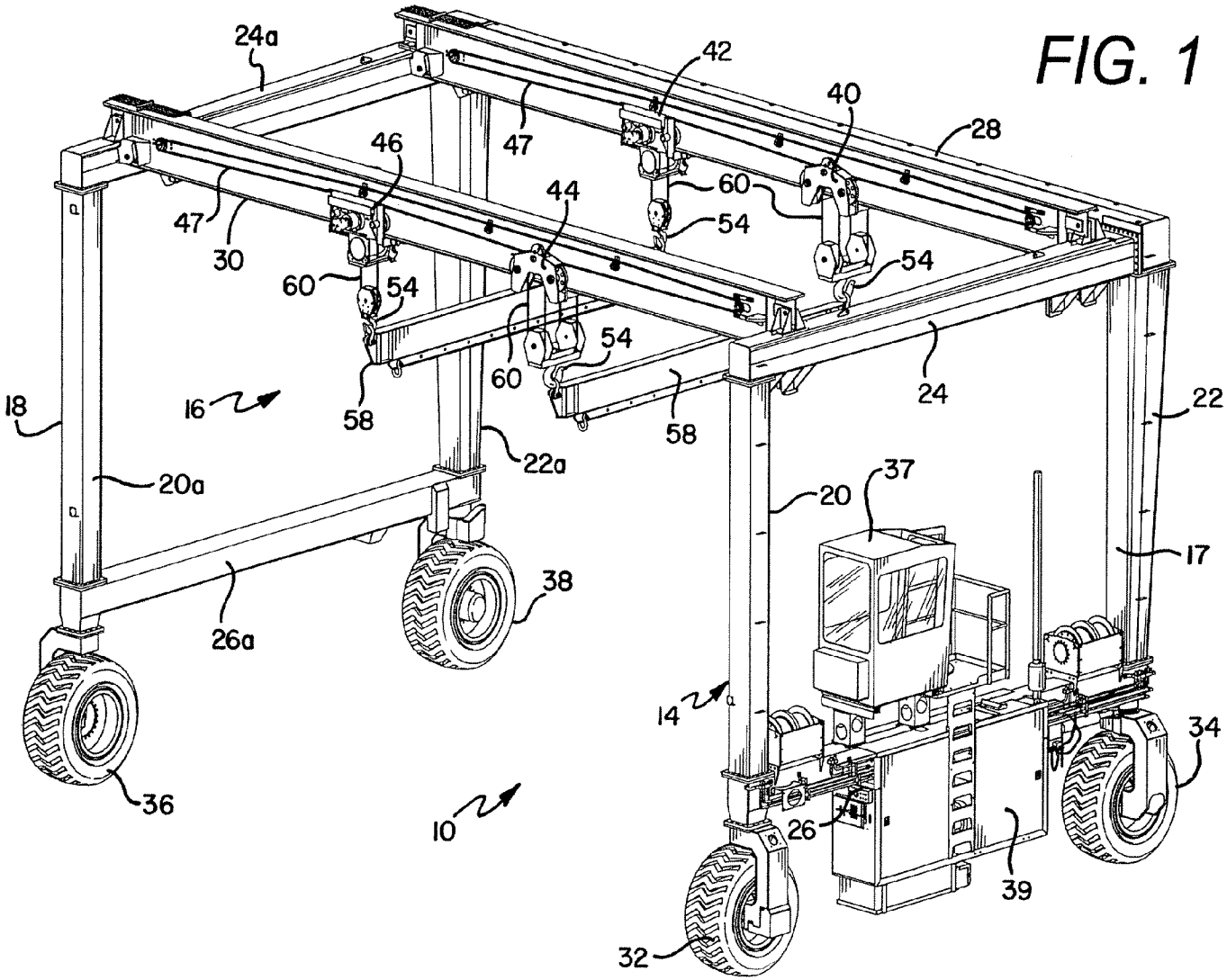
FIG. 1 is a perspective view of a gantry crane configured in a panel turner application according to the present invention.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a load lifting assembly 10 in the form of a gantry crane with load lifting features. In this preferred embodiment of the invention, the gantry crane 10 is configured in a panel turner application, and it is understood that the gantry crane 10 and panel turner structure can take various forms. The general structure of the gantry crane 10 will first be described followed by a description of certain features employed in the operation of the panel tuner features of the gantry crane 10.

The gantry crane 10 generally includes a load lifting support structure or frame 14 (i.e., a gantry structure), and lifting features 16—which can be applied as a panel turner—operably connected to the gantry structure 14.

The gantry structure 14 generally has a right side support frame 17 and a left side support frame 18 (reference to the "right" and "left" sides is from the perspective of one viewing the gantry crane 10 as it appears in FIG. 1). The right side support frame 17 and the left side support frame 18 are substantially identical in significant respects.

Referring to FIG. 1, the right side support frame 17 includes a right rear vertical leg 20, a right front vertical leg 22, a right upper side beam 24 and a right lower side beam 26. The upper side beam 24 and the lower side beam 26 span between and connect the right rear vertical leg 20 and the right front vertical leg 22. The lower side beam 26 also supports an operator cab 37 and control cabinets 39 that house various motors and controls utilized to operate the gantry crane 10.

A first upper, horizontal cross-beam 28 and a second upper, horizontal cross-beam 30 extend between and are connected to the right side support frame 17 and the left side support frame 18. A right rear wheel 32 is located near a lower end of the right rear vertical leg 20 and a right front wheel 34 is located near a lower end of the right front vertical leg 22.

Also referring to FIG. 1, the left side support frame 18 also similarly includes a left rear vertical leg 20*a*, a left front vertical leg 22*a*, a left upper side beam 24*a* and a left lower side beam 26*a*. The upper side beam 24*a* and the lower side beam 26*a* span between and connect the left rear vertical leg 20*a* and the left front vertical leg 22*a*. A left rear wheel 36 is located near a lower end of the left rear vertical leg 20*a* and a left front wheel 38 is located near a lower end of the left front vertical leg 22*a*.

The wheel base of the gantry crane 10 is the distance between the center of the rear wheels 32, 36 and the center of the front wheels 34, 38. The width of the gantry crane 10 is the distance between the mid-plane of the right side wheels 32, 34 and the mid-plane of the left side wheels 36, 38.

The four wheels 32, 34, 36, 38 allow for a mobile gantry structure 14. To accommodate such mobility, the gantry crane 10 can include a steering system used to control movements of the gantry structure, such as that disclosed in U.S. patent application Ser. No. 11/058,738, entitled "Steering System for Crane" owned by Assignee of the present invention and which is incorporated herein by reference.

The operator cab 37 shown attached to the right side support frame 17 can take other forms and be positioned at different locations. The operator cab 37 could also be mounted for vertical and/or horizontal movement between various locations. The control cabinets 39 could also be mounted in various locations.

Figure 2:
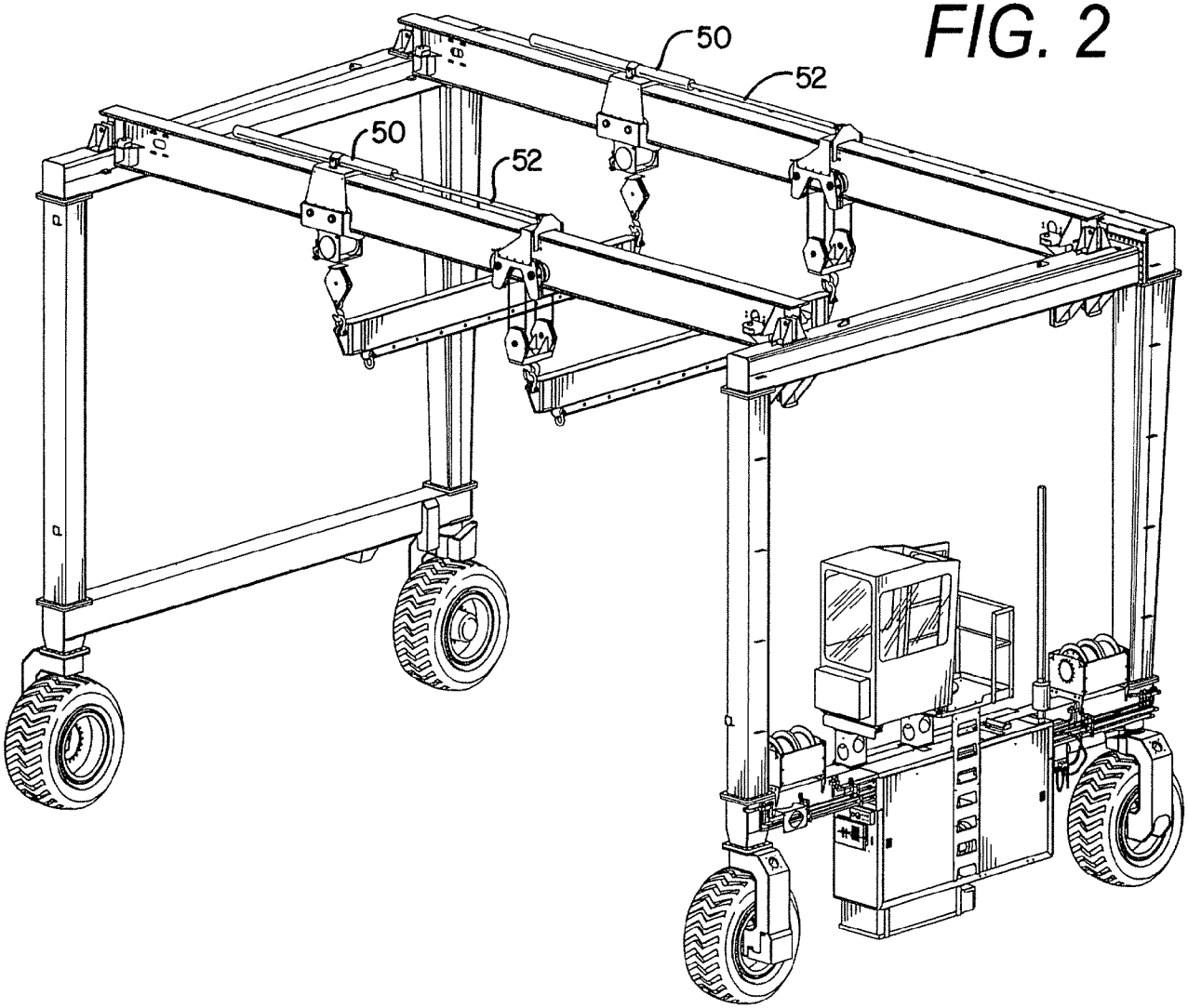
FIG. 2 is a perspective of an another embodiment of a gantry crane configured in a panel turner application according to the present invention.

The gantry crane 10 includes features for lifting and moving loads. Specifically, the first upper cross-beam 28 includes a first main hoist mechanism 40, and a first auxiliary hoist mechanism 42. Similarly, the second upper cross-beam 30 includes a second main hoist mechanism 44 and a second auxiliary hoist mechanism 46. Each of the hoist mechanisms 40, 42, 44, 46 can include a trolley assembly (as shown in FIGS. 1 and 2), or other similar structure, to facilitate lateral movement along the respective cross-beams 28, 30. In this instance, the hoist mechanisms and trolley assemblies are sometimes referred to as the "main hoist trolley" and the "auxiliary hoist trolley." Alternatively, in some embodiments, the hoist mechanisms 40, 42, 44, 46 can be fixedly mounted to a single location on the cross-beam.

In the embodiment of the invention shown in FIG. 1, the main hoist mechanisms 40, 44 are connected to chains or cables 47 located on the left hand sides (as viewed in FIG. 1) of the respective beams 28, 30. A motor is used to drive the cable 47 to position the main hoist mechanisms in the desired locations on the beams 28, 30. The respective auxiliary hoist mechanisms 42, 46 can be fixed to the chain (and thereby maintain a constant distance from the main hoist mechanisms 40, 44), or can be controlled by a separate drive motor (which allows the auxiliary mechanisms 42, 46 to be moved closer to or further from the main hoist mechanisms 40, 44) as described in more detail below. Alternatively, a second cable (e.g., mounted on the right hand side of the beam—not shown) can be utilized to move the auxiliary hoist mechanisms 42, 46 in the same manner as the main hoist mechanisms 40, 44.

According to the embodiment of the invention shown in FIG. 2, a hydraulic cylinder 50 having a reciprocating shaft 52 can be utilized to effect spacing between the respective main hoists 40, 44 and auxiliary hoists 42, 46. The hydraulic cylinder 50 is coupled to both the main hoist mechanism 40, 44 and the auxiliary hoist mechanism 42, 46.

Each hoist 40, 42, 44, 46 includes a load engagement member or element 54 for connecting the hoist mechanism either directly or indirectly to a load. In the embodiments of FIGS. 1 and 2, each hoist mechanism includes a load engagement member 54 in the form of a hook. The hooks 54 in the two main hoists 40, 44 and the two auxiliary hoists 42, 46 are shown engaged to a first and second cross bar 56, 58, respectively. The cross bars 56, 58 span between the respective main and auxiliary hoist mechanisms and can be used to connect the hoists to the load. Cables 60 in the hoist mechanisms 40, 42, 44, 46 are used to extend and retract the hooks 54, and to thus, lift and lower a load.

Figure 3:
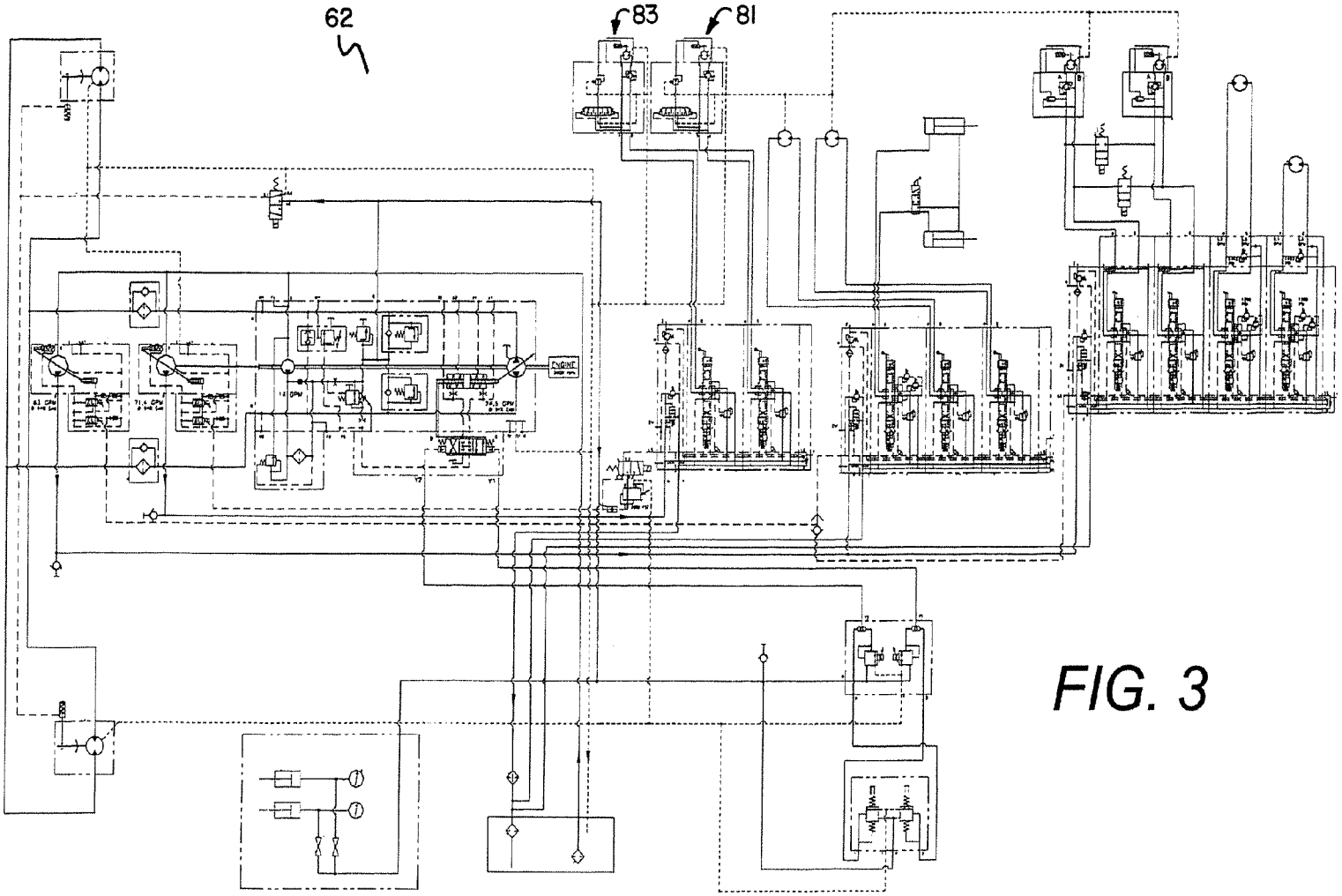
FIG. 3 is a schematic diagram of a hydraulic system utilized to control the lifting features of the gantry cranes in FIG. 1 and FIG. 2.

A hydraulic system 62 is used to control and operate the hoist mechanisms 40, 42, 44, 46. Referring to FIG. 3, a schematic diagram of the hydraulic system 62 is provided. The hydraulic system 62 includes a plurality of hydraulic circuits for controlling and operating each of the hoist mechanisms 40, 42, 44, 46.

The load lifting assembly 10 of the present invention includes various features that are employed to eliminate and/or reduce or minimize the chance for damage to the assembly 10 when lifting a heavy load. In one particular situation, these features are employed when lifting and turning a panel.

Figure 7A:
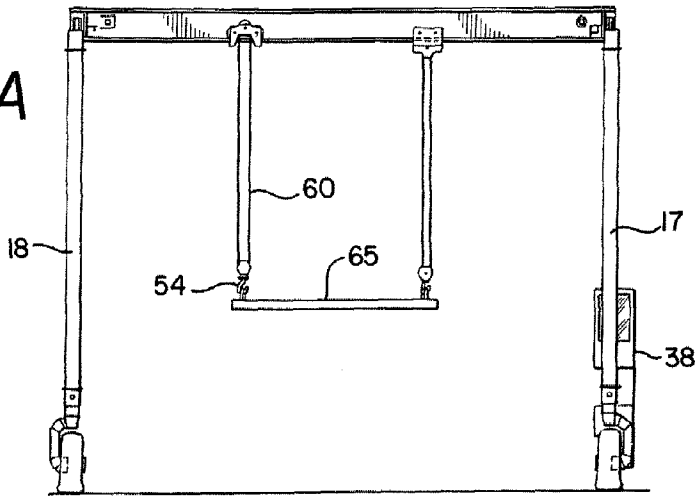
FIG. 7(A-C) are end views of a gantry crane of the present invention turning a panel to an upright position.
Figure 7C:
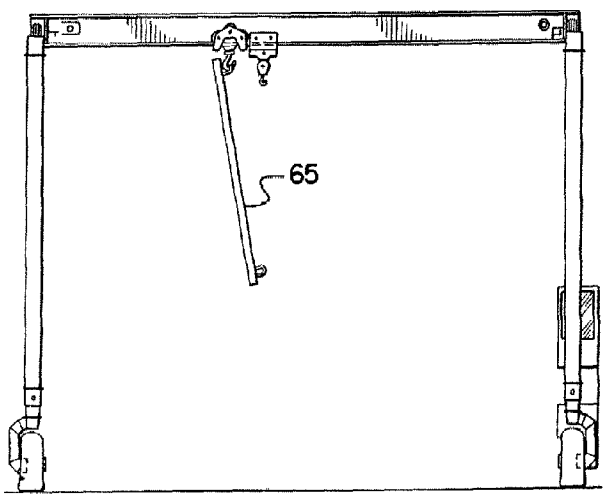
Figure 7B:
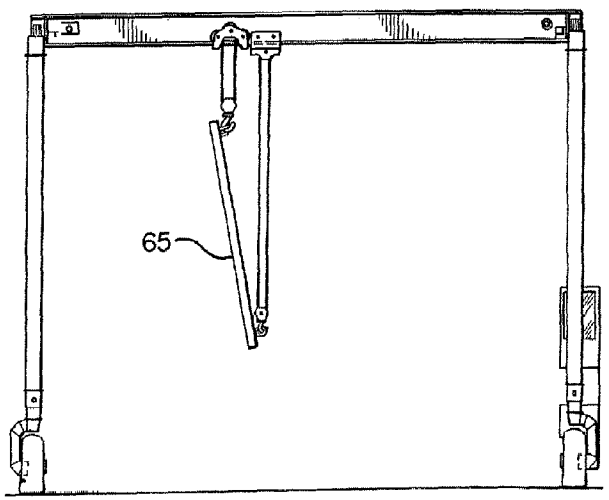

In the panel turner application shown in FIGS. 7A-7C, the lift assembly 10 is designed to lift and manipulate, for example, large prestressed concrete slabs or panels 65 that may weigh many tons apiece. The panel 65 is typically lifted from a horizontal position and manipulated to a vertical position for storage. All four hoist mechanisms are typically required to turn the panel.

One feature utilized when lifting a heavy panel (or other heavy load), is to reduce the lift capacity of one or both of the main and auxiliary hoist mechanisms. This is done to prevent damage to the support structure 14, and in particular, the cross-beams 28, 30 from overloading.

In a typical application, each horizontal beam 28, 30 of a gantry crane 10 is rated for capacity of 25 tons, for a total of 50 tons (the capacity rating is the maximum weight the component can safely lift without undue risk of failure or structural damage). Each main hoist mechanism 40, 44 is rated for a capacity of 25 tons (when operated with sufficient pressure from the hydraulic system 62) while each auxiliary hoist mechanism 42, 46 is rated for 12 tons, for a grand total of 74 tons. Accordingly, if all four hoist mechanisms 40, 42, 44, 46 are used in an application at full capacity, the lifting capacity of the hoist mechanisms (i.e., 74 tons) is greater than the lifting capacity of the cross-beams (i.e., 50 tons). Similarly, if only a main hoist mechanism and an auxiliary hoist mechanism on the same cross-beam are utilized, the lifting capacity of the two hoist mechanisms (i.e., 34 tons) is greater than the lifting capacity of the cross-beam (i.e., 25 tons) they are on.

To avoid damage to one or both cross-beams 28, 30 by attempting to lift a load heavier than the beam ratings, the present lifting assembly 10 includes a feature to limit the main hoist mechanism's lift capacity to a lesser amount when one or both auxiliary hoist mechanisms are utilized to lift a load. Preferably, the assembly reduces the main hoist mechanism's lifting capacity to 13 tons (or less). At this level, when combined with the auxiliary hoist mechanism (i.e., at a capacity of 12 tons), the lifting capacity of the main and auxiliary hoist mechanisms on each cross-beam will be 25 tons (or less). That is, the combined capacity of the two hoist mechanisms will be equal to (or less than) the cross-beam's rating.

Figure 4:
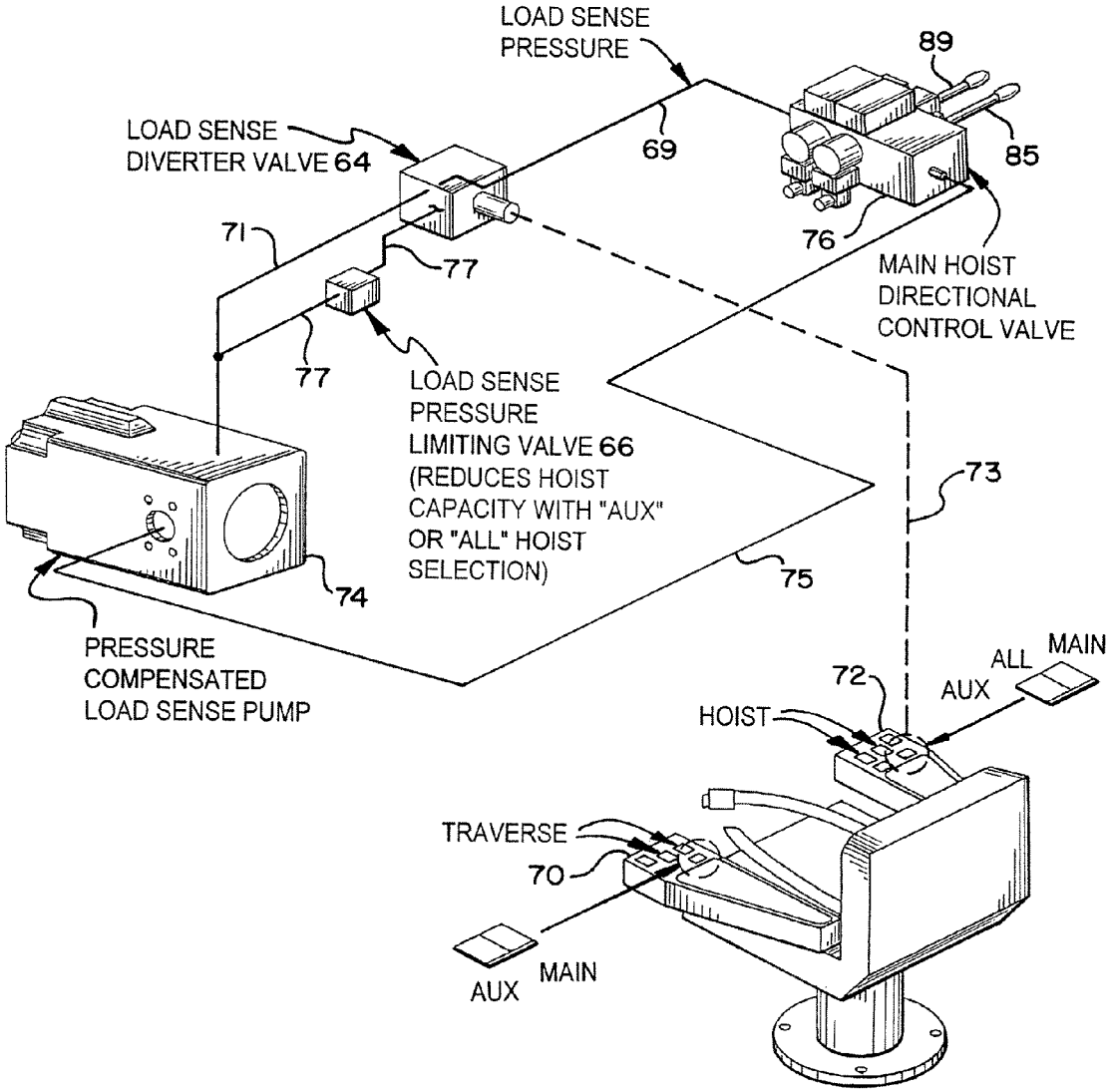
FIG. 4 is a diagrammatical view showing components of a portion of the hydraulic system configured to reduce the lifting capacity of a hoist mechanism of the gantry cranes in FIG. 1 and FIG. 2 according to the present invention.

As illustrated in FIG. 4, a hoist controller 68 (understood to be operably associated with the operator cab 37) is used to select and operate the hoist mechanisms 40, 42, 44, 46. The controller 68 includes a control 70 for effecting lateral movement of the hoist mechanisms 40, 42, 44, 46 along the respective cross-beams 28, 30, and another control 72 for operating the lift features of the hoist mechanisms 40, 42, 44, 46. A pressure compensated load sense pump 74 is used to drive a main hoist motor 81 or 83 (see FIG. 3). The main hoist directional control valve 76 includes a first output control line 85 connected to the hoist motor of the first main hoist mechanism 40 and a second output control line 89 connected to the hoist motor of the second main hoist mechanism 44. The directional control valve 76 controls extension (lowering) and retraction (lifting) of the load engagement member 54. The main hoist mechanism lift capacity is proportional to the pressure applied to the main hoist directional control valve 76 by the pressure compensated load sense pump 74 through a hydraulic pressure line 75.

Still referring to FIG. 4, to reduce pressure in the pressure line 75 the hydraulic system utilizes a load sense diverter valve 64 and a load sense pressure limiting valve 66 to effect the main hoist mechanism capacity reduction. When only the main hoist mechanism is selected, pressure from the main hoist directional control valve 76 via control line 69 is directed to the pressure compensated load sense pump 74 through load sense diverter valve 64 via control line 71 (e.g., causing the pump to apply 3500 psi pressure to the pressure line 75). However, if the auxiliary hoist mechanism is selected, or all of the hoist mechanisms 40, 42, 44, 46 are selected by the operator, a hoist command signal from the controller 68 via electrical line 73 causes the diverter valve 64 to divert pressure from the directional control valve 76 through the load sense pressure limiting valve 66 to the pump 74 via control lines 77 (e.g., causing the pump to reduce the pressure to 1750 psi in the pressure line 75). This causes the pump 74 to reduces the pressure in pressure line 75 applied to the main hoist directional control valve 76, and thus reduces the main hoist mechanism's lifting capacity (again, preferably to 13 tons or less in the example given above). This protects the crane from overloading the overhead horizontal cross-beams 28, 30. With this feature, the total lifting capacity of the main and auxiliary hoist trolleys does not exceed the rating of the horizontal cross-beam to which the trolleys are mounted. It is understood that while certain numerical values for the ratings and hoist reduction capacities are referenced, these values can vary as desired with the structure of the crane 10.

The reduction in lift capacity can also be accomplished with a dual speed displacement motor. The dual speed displacement motor can include a first setting for maximum displacement (i.e., for maximum load) and a second setting for less than maximum displacement (i.e., for a reduced load). The second setting can be set to a value that prevents lifting loads above the beam ratings. An electronic controller can be used to shift the motor from one displacement to the other.

Figure 5:
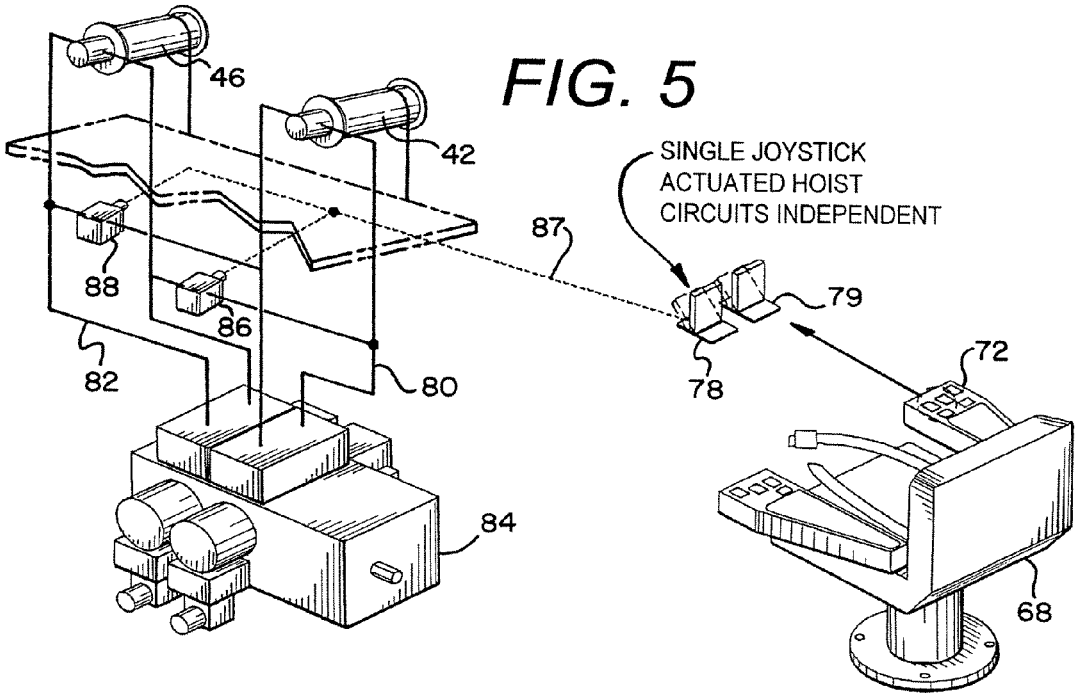
FIG. 5 is a diagrammatical view showing components of a portion of the hydraulic system that can be used to equalize the hoisting ability of the main or auxiliary hoist mechanisms of the gantry cranes in FIG. 1 and FIG. 2 with equalization valves not energized.
Figure 6:
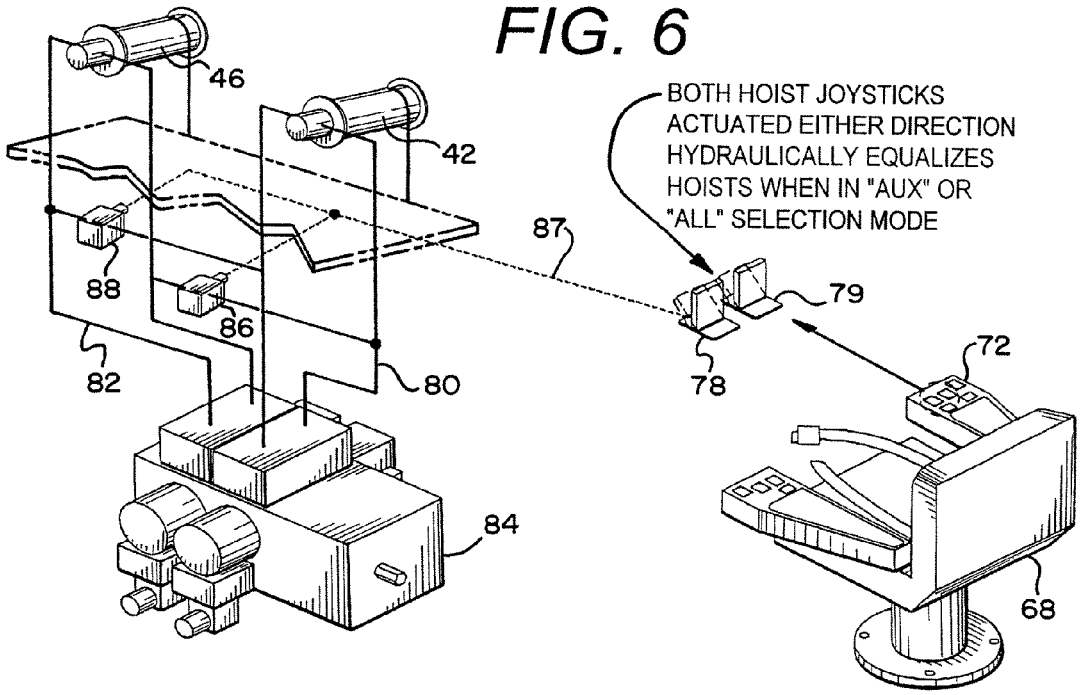
FIG. 6 is a diagrammatical view showing the components of a portion of the hydraulic system configured to equalize the hoisting ability of the main or auxiliary hoist mechanisms of the gantry cranes in FIG. 1 and FIG. 2 with the equalization valves energized according to the present invention.

Another feature employed by the load lifting assembly 10 to avoid damage to the gantry crane structure 14 or the load 65, is hoist equalization. Referring to FIG. 5 and FIG. 6, the hydraulic system 62 of the gantry crane 10 provides for equalizing the hoisting capacity of the main or auxiliary hoist mechanisms 40, 42, 44, 46 in certain applications.

As shown in FIG. 5, the control 72 includes a first joystick 78 and a second joystick 79. If a single joystick 78 of the control 72 is actuated, first and second hoist circuits 80 and 82, operably coupled to the auxiliary hoisting mechanisms 42, 46, respectively, operate independently. A common auxiliary directional control valve 84 is used to operate both auxiliary hoisting mechanisms 42, 46.

However, if both hoist joysticks 78, 79 are actuated, the hydraulic system 62 utilizes a common hydraulic line to hydraulically equalize the hoists. This is accomplished by energizing equalization valves 86, 88 via electrical control line 87 to combine the flow path of the hydraulic circuits 80, 82 as shown in FIG. 6.

This hoist equalization feature will assure that the auxiliary hoist mechanisms are then carrying equal portions of the load.

This helps to lift the panels 65 more efficiently and safely. Although described with respect to the auxiliary hoist mechanisms, similar components are utilized to equalize the two main hoist mechanisms 40, 44.

The features of the present invention provide significant advantages. The ability to reduce the capacity of the main hoist trolley protects the crane 10 such that the main and auxiliary hoist trolleys, operating together, cannot lift a load that is greater than the rating of the horizontal beam supporting the hoist trolleys. The gantry structure is thus protected from a potential failure. The hoist equalization feature allows the crane 10 to lift loads such as pre-stressed concrete panels more efficiently and safely. With the hoists equalized during certain lifting of a panel, the panel is also not stressed in undue fashion that could potentially damage the panel.

As discussed above, in one embodiment of the invention the auxiliary hoist mechanisms 42, 46 are powered for controlled movement along the respective upper cross-beams 28, 30. This allows for independent positioning of the auxiliary hoist mechanisms 42, 46 on the cross-beams 28, 30.

Figure 8:
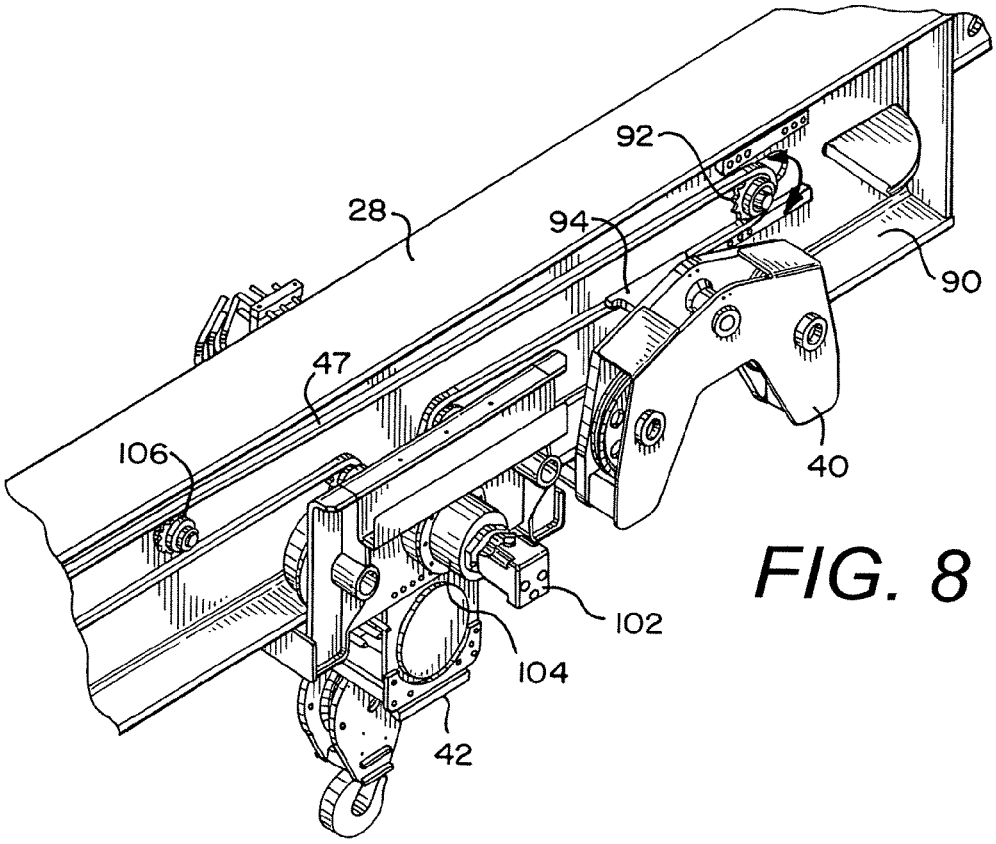
FIG. 8 is a partial perspective view of the main hoist trolley and the auxiliary hoist trolley on one side of a beam in accordance with an embodiment of the present invention; and, FIG. 9 is perspective view of the opposite side of the main hoist trolley and auxiliary hoist trolley shown in FIG. 8 with the beam removed for clarity.
Figure 9:
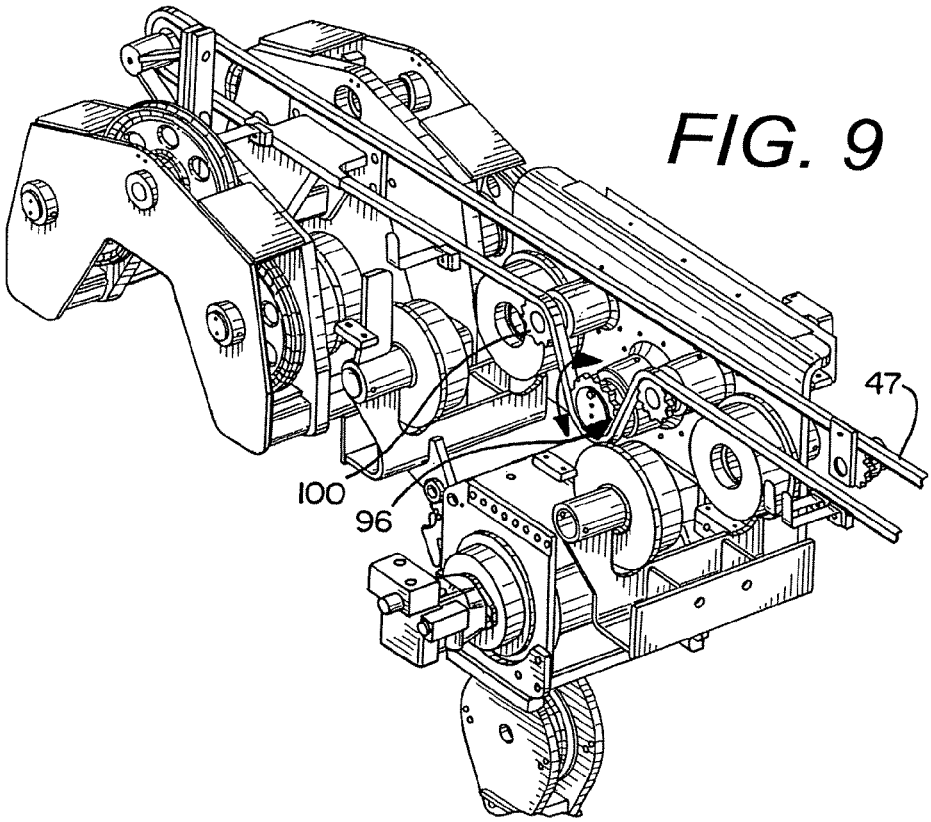

Referring to FIGS. 8 and 9, the main hoist mechanism 40 and the auxiliary hoist mechanism 42 are shown connected to the upper cross-beam 28, and are coupled to the cable 47. The cable 47 is connected to the upper cross-beam 28 in the form of a continuous, elongated loop, which extends along the upper cross-beam 28 from a position proximate a first end 90 of the upper cross-beam 28 to a position proximate a second end of the upper cross-beam (the second end of the upper cross-beam 28 is shown in FIG. 1). The cable 47 can be formed from a chain having a plurality of linked segments.

A first cable drive sprocket 92 is shown proximate the first end 90 of the cross-beam 28 with the cable 47 positioned around the drive sprocket 92. The drive sprocket 92 is connected to a motor for rotating the sprocket 92 either clockwise or counter-clockwise. Rotational movement of the drive sprocket 92 drives the cable 47 about the loop.

The main hoist mechanism 40 includes a trolley assembly having a segment 94 that is secured to the cable 47 at a fixed point on the cable 47. Accordingly, rotational movement of the cable 47 about the loop causes the trolley assembly of the main hoist mechanism 40 to move the main hoist mechanism 40 along the upper cross-beam 28.

The auxiliary hoist mechanism 42 includes an auxiliary trolley assembly which is moveably coupled to the cable 47. As shown in FIG. 9, the auxiliary trolley assembly includes an auxiliary hoist mechanism drive sprocket 96 in contact with the cable 47 between two guide sprockets 98 and 100. A motor 102 and planetary gear box 104 in the auxiliary hoist mechanism (shown in FIG. 8), are used to rotate the auxiliary hoist mechanism drive sprocket 96, either clockwise or counterclockwise. In this manner, the auxiliary hoist mechanism can move under its own power along the cable 47 to a desired position on the cross-beam 28.

Additional sprockets 106 (and in particular, one proximate the second end of the cross-beam) can be positioned on the cross-beam 28 to guide and/or drive the cable 47.

Alternatively, the auxiliary hoist mechanism can be connected to a second cable (i.e., on the other side of the beam) to be powered in a similar manner as the main hoist mechanism.

While the specific embodiments have been illustrated and described, numerous modifications come to mind without significantly departing from the spirit of the invention, and the scope of protection is only limited by the scope of the accompanying Claims.

What is claimed is:

1. A gantry crane comprising:

a first side support frame;

a second side support frame;

a first cross-beam having a first end connected to the first side support frame and a second end connected to the second side support frame;

a second cross-beam having a first end connected to the first side support frame and a second end connected to the second side support frame, the second cross-beam being spaced from the first cross-beam;

a first hoist mechanism on the first cross-beam, the first hoist mechanism having a first main hoist mechanism and a first auxiliary hoist mechanism and a first drive assembly operably coupled to the first main hoist mechanism and the first auxiliary hoist mechanism wherein the first main hoist mechanism and the first auxiliary hoist mechanism are driven along the first cross-beam, the first hoist mechanism being capable of raising and lowering a load; and a second hoist mechanism on the second cross-beam, the second hoist mechanism having a second main hoist mechanism and a second auxiliary hoist mechanism and a second drive assembly operably coupled to the second main hoist mechanism and the second auxiliary hoist mechanism wherein the second main hoist mechanism and the second auxiliary hoist mechanism are driven along the second cross-beam, the second hoist mechanism being capable of raising and lowering the load, wherein the first drive assembly is capable of moving the first main hoist mechanism and the first auxiliary hoist mechanism along the first cross-beam independently of one another, and wherein the first drive assembly includes a first chain drive operably coupled to the first cross-beam wherein the first main hoist mechanism and the first auxiliary hoist mechanism are operably connected to the first chain drive.

2. The gantry crane of claim 1 wherein the first main hoist mechanism is fixedly secured to the first chain drive.

3. The gantry crane of claim 2 wherein the first auxiliary hoist mechanism includes a motor mounted in the first auxiliary hoist mechanism for moving the first auxiliary hoist mechanism along the first chain drive.

4. The gantry crane of claim 3 wherein the second drive assembly is capable of moving the second main hoist mechanism and the second auxiliary hoist mechanism along the second cross-beam independently of one another.

5. The gantry crane of claim 4 wherein the second drive assembly includes a second chain drive operably coupled to the second cross-beam wherein the second main hoist mechanism and the second auxiliary hoist mechanism are operably connected to the second chain drive.

6. The gantry crane of claim 5 wherein the second main hoist mechanism is fixedly secured to the second chain drive.

7. The gantry crane of claim 6 wherein the second auxiliary hoist mechanism includes a motor mounted in the second auxiliary hoist mechanism for moving the second auxiliary hoist mechanism along the second chain drive.

8. The gantry crane of claim 1, wherein the first main hoist mechanism, the first auxiliary hoist mechanism, the second main hoist mechanism, and the second auxiliary hoist mechanism are capable of cooperatively lifting and manipulating a concrete panel comprising the load.

* * * * *